United States Patent [19]

Ressi di Cervia

[11] Patent Number: 4,696,607

[45] Date of Patent: Sep. 29, 1987

[54] SLURRY TRENCH METHOD AND APPARATUS FOR CONSTRUCTING UNDERGROUND WALLS

[75] Inventor: Arturo L. Ressi di Cervia, New York, N.Y.

[73] Assignee: Finic, B.V., Rotterdam, Netherlands

[21] Appl. No.: 173,538

[22] Filed: Jul. 30, 1980

[51] Int. Cl.[4] ..... E02D 5/00; E02D 29/00

[52] U.S. Cl. ..... 405/267; 37/58; 405/179

[58] Field of Search ..... 405/116, 117, 162, 164, 405/179, 267, 163; 37/58

[56] References Cited

U.S. PATENT DOCUMENTS

| | | | |
|---|---|---|---|
| 808,800 | 1/1906 | Wright | 405/117 |
| 3,495,409 | 2/1970 | Riedemann | 37/58 X |
| 3,583,170 | 6/1971 | DeVries | 405/162 |
| 3,645,101 | 2/1972 | Sherard | 405/267 |
| 3,845,631 | 11/1974 | Malan | 405/116 |
| 3,893,302 | 7/1975 | Peterson | 405/267 |
| 4,274,760 | 6/1981 | Norman | 405/162 X |

FOREIGN PATENT DOCUMENTS

| | | | |
|---|---|---|---|
| 1286521 | 8/1972 | United Kingdom | 405/163 |

*Primary Examiner*—David H. Corbin
*Attorney, Agent, or Firm*—Jim Zegeer

[57] ABSTRACT

A system for constructing narrow underground walls utilizing the slurry trench method is disclosed wherein a first apparatus excavates from one end of a slurry filled trench and a second apparatus is utilized for filling the trench with a wall forming material and at least a part of the excavating and/or filling apparatus is floated on the slurry in the trench. In one disclosed embodiment, narrow cut-off walls are formed by excavating from one end of a slurry filled trench and backfilling the trench at the opposite end by depositing therein a mixture of excavated soil and bentonite slurry from the trench, and includes a relatively large float adapted to be immersed in the slurry to prevent loading on the trench walls and stabilizing the apparatus for excavating purposes. In a further embodiment, in combination with a float-fin, low pressure tires or crawler treads bear a portion of the load and the distribution between the float and the ground engaging apparatus is accomplished by adjusting the bouyancy of the float, and the bouyancy of the float being adjusted by admitting or removing slurry or other liquid from the interior of the float.

14 Claims, 8 Drawing Figures

SLURRY TRENCH METHOD AND APPARATUS FOR CONSTRUCTING UNDERGROUND WALLS

BACKGROUND AND BRIEF DESCRIPTION OF THE INVENTION

Slurry trenching methods for forming narrow underground walls has been extensively developed in recent years by the assignee hereof and is now widely used all around the world (See the text "The I.C.O.S. Company in Underground Works" Vol. 3, I.C.O.S. Milan 1968 and also see the text by R. G. H. Boyce entitled "Structural and Cut-off Diaphragm Walls"; John Wiley and Sons (1978). In this technology, the slurry, frequently a mixture of sodium bentonite and water and possibly other chemicals, permits open trench excavation to be carried out without mechanical bracing or shoring-up of the walls because the slurry is heavier than water and develops a pressure in the trench which in conjunction with a bentonite cake supports the side walls of the trench until the wall forming material is inserted in the trench. Frequently, the wall forming material is a mixture of bentonite slurry and excavated soil which has been prepared to have a certain consistency in a backfill operation or step. Thus, a trenching machine can be used to move along the line of the wall and as it excavates soil material, the soil can mix with the bentonite in the slurry, or from a separate source, and with or without further processing, the excavated material can be backfilled into the core of the trench. Sometimes, the excavated material is laid to a special area beside the trench where various machines are used to reduce the backfill to the proper consistency and then it is simply bulldozed into the trench. In other cases, the backfill material is processed through shakers screens and the like which are moved along the side of the trench. At any rate, the heavy equipment used for excavating the trench, processing the slurry and preparing the backfill can sometimes overload the sides of the excavation and hence require a very large amount of working space and room.

The object of the present invention is to provide an excavating apparatus and method which floats on the slurry in the trench. A further object of the invention is to float at least a portion of the apparatus on the slurry and provide in one single operation the excavation of deep slurry trenchs, mixing and the placing of the backfill. A still further object of the invention is to utilize the slurry in the trench to support all or part of the wall forming apparatus.

A further object of the invention is to reduce the equipment working space required along the line of the wall and to make the equipment narrow. This is particularly significant when a working platform (the space along the line of the wall that is leveled and/or stripped for performance of the work) of a minimum width has to be created to perform the work by building an embankment (on a dike for example) or cutting a trough (in uneven terrain for example) along the line of the wall and which, by its nature has to have a minimum slope.

While the invention is directed to making underground walls, it will be appreciated that the invention cal also be used for laying pipe, utility lines, cables etc.

According to the present invention, these functions can be performed automatically for the construction of a cut-off wall without overloading the sides of the trench and also will provide automatically alignment of the backfill into the trench itself. The apparatus is comprised substantially of four parts:

a floatation device,
a mixing and placing unit,
a cutting head and
a power pack.

The floatation device can be of several different forms. By stacking floats in modular form, several tons of floatation can be achieved even in a very narrow trench. The mixing apparatus as well as the conveyor belt delivering the backfill are floating in a preferred embodiment and do not vertically load the sides of the trench. As opposed to what occurs when the backfill is placed by a bulldozer, the stability of the trench will not be jeopardized by vibrations. The modular float system can be easily transported and adapted to various job conditions. Finally, by introducing into the floats more or less liquid, which, in the preferred embodiment, will be of same composition as the slurry in the trench, greater or less floatation can be achieved so as to increase traction on low pressure wheels and/or tractor crawler treads so that the loading on the side walls can be very precisely controlled.

When the wall is to be a mixture of soil and bentonite, the mixing and placing unit is preferably a floating unit which will be stabilized by low pressure tires which will be just barely loaded and will not create substantial pressure on the sides of the trench. As indicated above, the loading on the tires or the caterpillar treads can be adjusted by partial flooding of the float, if this be desired. This floating unit can also act as a platform for the measurement to the bottom of the trench as well as for accomodating rock removing devices and/or for creating a key in the bottom of the trench. By regulating the input of the air lift, the speed of the vibrating drum, the backfill mix composition can be easily adjusted to suit any consistency required. Since the backfill material is, in a preferred embodiment, constituted by excavated soil mixed with the bentonite slurry from the trench, the mixing unit can be a vibrating drum or screen into one end of which the excavated soil material is introduced, the slurry is returned to the trench directly below the vibrating drum and a mixture of soil and bentonite is delivered from the opposite side to the floating conveyor to be delivered to the opposite end of the trench from the excavating end.

The system allows for easy addition to the backfill material at the mixing point and for changes in the grain size distribution of the backfill. The backfill can be given added strength or can be modified with the addition of chemical additives, cements and the like at the mixing point, if this is desired. Since the typical yield of worked excavated material exceeds the volume of soil in place by some 20 to 30% (where this is the kind of wall being constructed) this additional material can be deposited as a continuous cap over the trench which results in the following additional advantages: (a) the requirement of a clay cap which is almost always present in slurry trench construction is automatically satisfied, (b) excess material will fill any settlements of the backfill and (c) when no longer required can be easily removed at a later date but it does not require additional working area.

The cutting head can be any of a variety types powered by submersible motors driven by hydraulic, electric and/or mud pumps. Depending upon the various types of cutting head configurations, they can reach any practical depth since the cutting head can be weighted down at the bottom and connected to the mixing unit by a flexible hose which will carry the soils up with an air lift. Moreover, the cutting head can be changed easily to operate in different types soils and the cutting head can also operate vertically and be part of the mixing and placing unit. Moreover, the cutting head can be a screw conveyor operated in a reverse direction to convey the excavated soil material in a downward direction to an air lift located at the bottom of the trench so that the bottom of the trench will always be clean as the excavation proceeds.

The power pack can move ahead of the trenching operation, if desired, without loading the sides of the excavation and acting as a tractor. The power pack contains air, electric or hydraulic power as may be required. If the use of an air lift in the cutting head will necessitate a pretrenching to a selected minimum low depth, such pretrenching operation can be performed by the power pack unit if desired. Because of the flexible configuration of the machine in plan, it can follow curve contours. Due to its fully automatic operation, it minimizes the use of personel, especially a non-union areas. It is composed of easily replaced parts and therefore it is highly efficient. The combination of the power pack and mixing and placing unit can be consolidated in one apparatus which will excavate a vertical face of the trench. Due to the use of air lift, the machine automatically cleans and descends to the bottom of the excavation as it progresses, eliminating this separate operation which is typically required in slurry trench construction. Due to the geometry of the cutting head it can be easily adapted to very irregular contours of the bottom of the trench and the cutting head and the mixing unit can easily accomodate a walking beam system operating a chisel at the bottom to provide for keying the slurry trench into the underlying rock formation if desired.

BRIEF DESCRIPTION OF THE DRAWINGS

The above and other objects advantages of the invention will become more apparent from the following specification when considered with the accompanying drawings wherein.

The invention comprises a self-contained unit filling all functions required to construct various kinds of underground walls, such as watertight barrier of the soil bentonite type, concrete (with and without reinforcements) cement bentonite, pre-cast panels, etc. In all embodiments an initial excavation is made and filled with a slurry, typically a mixture of bentonite and water and the floating portions of the unit installed therein.

Figure 1:
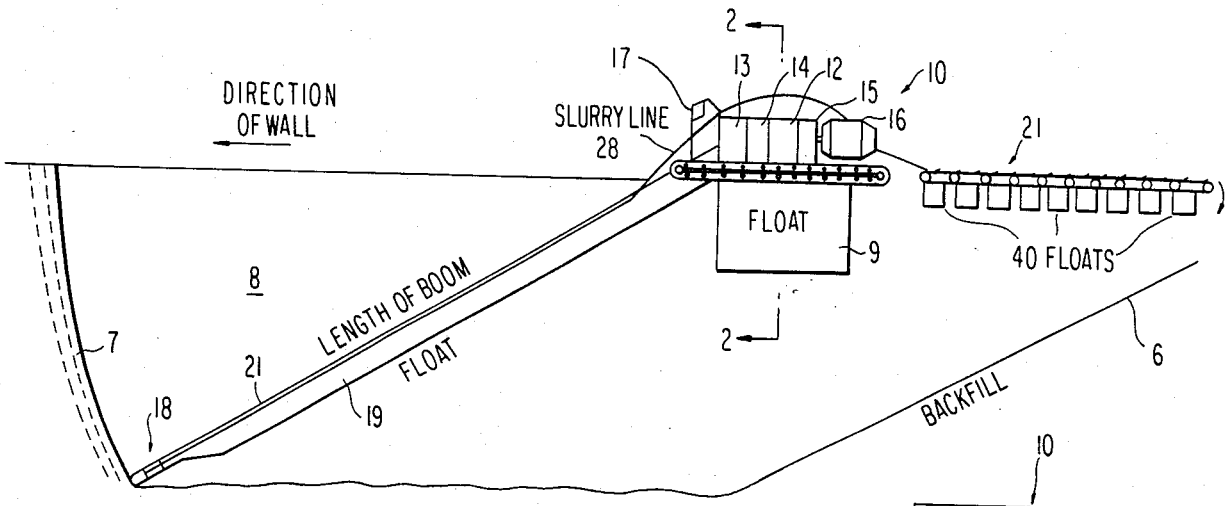
FIG. 1 is a diagrammatic illustration of a slurry trench apparatus incorporating the invention.
Figure 2:
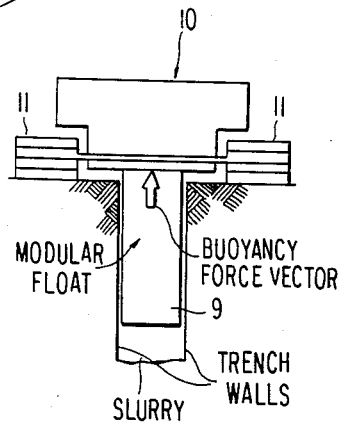
FIG. 2 is a sectional view through lines 2—2 of FIG. 1 showing a section through the float and stabilizer.

Referring to FIGS. 1 and 2 a semi-submersible unit 10, mostly floating on floatation unit 9 but with sufficient bearing on the ground to be propelled by crawler or low pressure tires.

As diagrammatically shown in FIG. 1 this unit incorporates some or all of the following: a general power pack 12 providing all hydraulic power required, generator 13 providing all electric power required, compressor 14 to provide compressed air for regulating floatation of all units and power ejector, a slurry mixing unit 15 which may be automatic in operation or operator controlled, a spoil to backfill processor 16 or other apparatus for inserting the wall forming material (in the embodiment of FIG. 8, the wall forming material is still reinforced concrete), and an operator's cab 17.

Cutting head unit 18 incorporating a transmission, drive motor, ejector or pumping system is carried on the end of boom unit 19 which connects the cutting head unit 18 to the semi-submersible dredge unit 10. Boom unit 19 can be of a semi-submersible type when cutting is done on a circle, or of a kelly type (See FIG. 3) when cutting a vertical bench.

Floating belt conveyor unit 22 is towed by the dredge unit to deliver the processed backfill from backfill processor 16 to the top of the backfill 6.

In conventional slurry trenching the equipment works on firm ground going backwards. In this invention at least a portion of the apparatus is floated on the slurry 8 and progresses forward and is located between the cutting zone 7 and the backfilling zone 6. For this reason the heavy apparatus can create inadmissible surcharges with regard to the trench stability. In this invention with a semi-submersible dredge 10 most of the weight is carried by floatation 9 (oriented with the center of gravity of dredge unit 10) and only the amount of weight that is required by the drive train or ground engaging traction means 11 to propell the unit is transferred to the ground. The ground pressure of the drive train or ground engaging traction means 11 is variable as ballasting of the floats is achieved. As described in regard to FIG. 5, a pump 45 can be used to pump more or less liquid, such as bentonite, slurry, into float 9 to thereby adjust the buoyancy of same and the loading by the traction means on the earth walls of the slurry filled trench.

The presence of the float 9 under the unit 10 provides added safety with regard to trench collapse providing emergency bracing of the trench.

Components of the unit described above can be installed on a single dredge unit 10 or on a train of floating sub-units.

For constructing an impermeable soil-bentonite wall, for example, the main feature of unit 10 is the spoil to backfill processor 16, which is a combination of conventional vibrating screens and blenders, to reduce the fluid content of the cuttings or soil sent by the ejector or pumps at cutting head 18. The spoil to backfill processor 16 homogenizes the backfill mix to the right consistency prior to being discharged on the belt conveyor delivery unit 21 which is carried by a series of floats 40.

This processor works in a continuous manner and is adjustable to suit the requirements of the wall being constructed. Additive materials, either granular or chemical and cement, sand etc. . . can be added to the processor by service vehicles moving along the trench 5 or on firm ground.

The cutting head 18 can be of a variety of devices adjusted to different ground conditions varying from soft clays to rock and powered by electric, hydraulic or pressurized pump motors.

Depending upon the depth circulation, cuttings in the slurry line will be provided by ejectors or slurry pumps. The concept of the cutting head is identical in both approaches of the floating boom or the Kelly attachment. In both cases the cutting head is easily brought to the surface for maintenance and changing tools.

The submersible boom 21 unit connects the cutting head 18 to the dredge unit 10. As is well known its basic principle is to provide the motion of the cutting head 18, transfer the source of power to the head and permit the return, via slurry line 28, of the cuttings to processing unit 16. Its articulation, fixed to the dredge unit 10, forces the cutting head 18 to describe a circle in a vertical plane. The travel is provided by ballasting and pumping air in the float 19 which ultimately can raise the boom above fluid surface. In order allow the system to trench large radius curves, the boom is articulated in various points so that it may be steered. This requires that all power feeding lines and slurry lines are also articulated or flexible.

Figure 3:
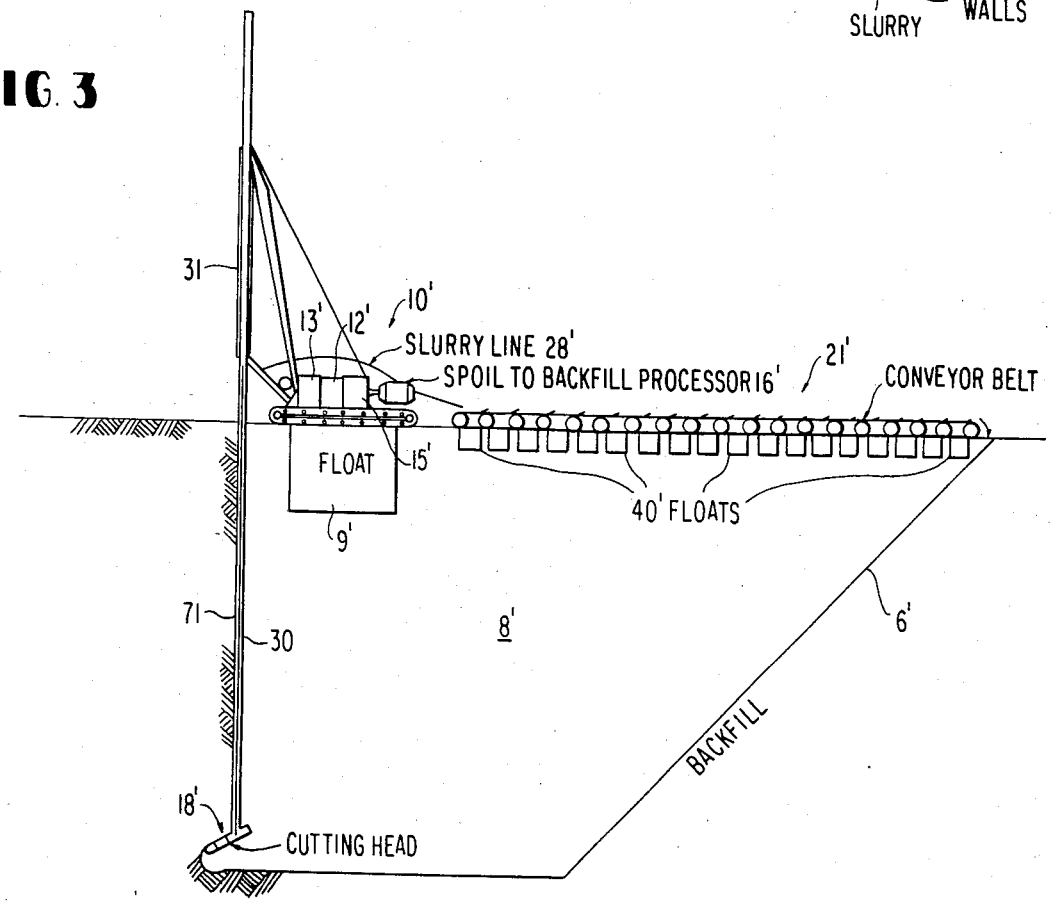
FIG. 3 is a diagrammatic illustration of a further embodiment of a slurry trenching apparatus incorporating the invention wherein a cutting head is on the end of a kelly bar.

For lesser depths than the submersible boom, the kelly boom 30 shown in FIG. 3 carries the cutting head unit 18 at the bottom extermity and travels vertically, sliding in a kelly guide 31' attached to the dredge unit 10'.

The cutting force to the head is provided by traction of the kelly boom 30 for ascending cutting and by the dead weight of the system for descending cutting. Motion of kelly boom 30 is controlled, as is conventional, by either wire, rope, chain and hydraulic piston or rack and pinion. Flexible power and slurry lines assure a flexible connection between the kelly and the various components of the dredge floating in the slurry trench. If an air lift is not used, the compressor can be eliminated and the cuttings raised to the surface on the slurry line as it is drawn upward by a mud pump (not shown).

The floating belt conveyor 21' is towed and powered by the dredge unit 10' and has the function of delivering the backfill coming out of the processor to the top of the backfill slope 6'. It is made of a series of individual belt conveyors supported by floats 40' partially stacked or overlapped to allow telescoping action and acticulation of the whole unit. Telescoping assures that the backfill material is poured at the location of the top of the backfill slope 6'; which may vary. Even when trenching at constant depth, articulation of the unit allows the unit to follow the curves of the trench.

Thus the invention integrates in one mechanical ensemble all functions required to build a soil-bentonite impervious cutoff. It permits the formation of a continuous trench in any soil strata and soft to medium rock formation and at unprecedented depths and production rates. Its modular mechanical conceptions makes it a highly serviceable and easy to maintain which should result in minimum downtime.

The fully automated operation puts the operator in a monitoring role more than operating. Proper manning of the machine represents a major reduction in labor costs in comparison to a conventional slurry trenching operation.

Adaptability to various geological formations, bottom profiles, alignment contours accomodate many medium to large projects and offer a clear reduction in construction costs relative to present state of the art.

Figure 4:
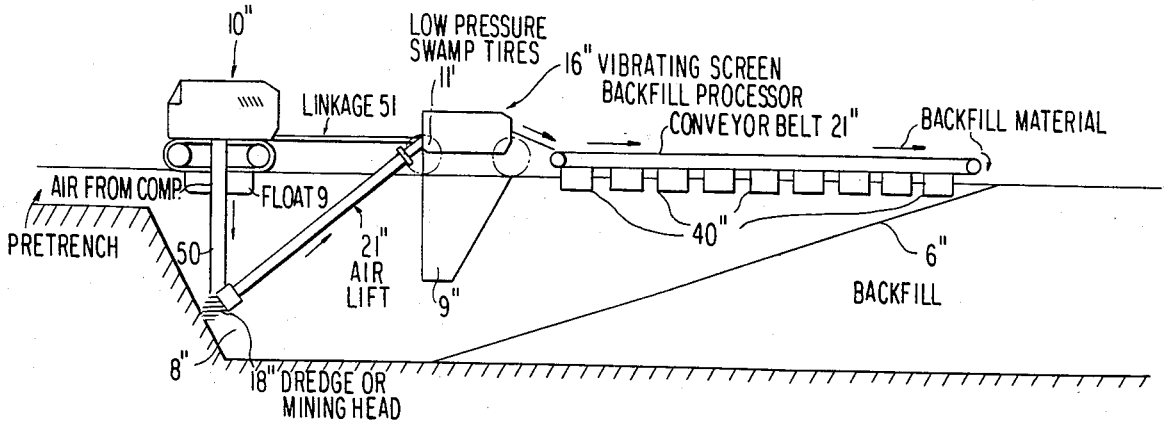
FIG. 4 is a diagrammatic elevational view of a further embodiment of a slurry trench apparatus incorporating the invention wherein the backfill processing unit is on a separate unit which is coupled to the power pack unit by a linkage and a pretrench has been excavated according to the invention.

In FIG. 4, the excavating unit 18" is a dredge or mining head which is supplied by air from a line 50 coupled to the air compressor 14 (not shown) or partially floated semi-submersible unit 10". A linkage 51 couples the unit 10" to the vibrating screen which receives the excavated material and slurry mixture through air lift line 21" and process the material to the desired consistency of slurry and soil and delivers same to the conveyor 21". In this embodiment, all of the units are articulated one to the other and provided with their own separate floatation elements. It will be appreciated that the float shown in the unit 10" can be removed and the unit travels to the left over the pretrench, which can be formed by a backhoe or drag line or other excavating equipment. Again, more or less traction can be accomplished by changing the buoyancy of the floats 9" on the power pack unit 10" or vibrating screen unit 16". Also, in the embodiment if FIG. 4, the low pressure swamp tires 11" are used to provide lateral stability for the vibrating screen 16".

Figure 5:
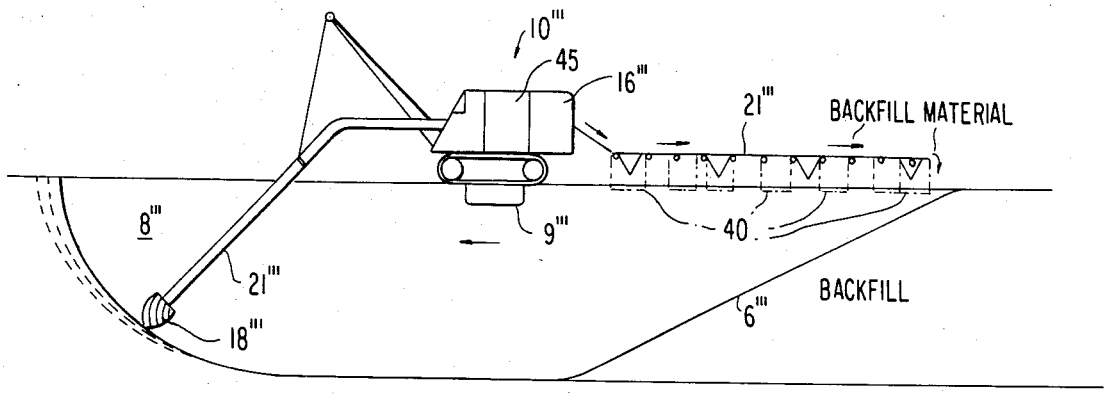
FIG. 5 is a diagrammatic elevational view of a further embodiment of a slurry trench wall forming apparatus incorporating the invention.

Another embodiment of the invention is illustrated in FIG. 5 wherein the excavation is performed by a cutting head 18''' and an air lift unit 21''' is provided to receive air from the compressor in the power pack unit 10''' and couples the excavated soil material, slurry and returned air to the backfill processing unit 16'''. The material is deposited at the backfill end of the trench by the floating conveyor 21'''. In this case, a small boom is used to swing the excavating head 18''' on an arc. It will be appreciated that a pretrench, as shown at 52 in FIG. 4 may be incorporated in all embodiments where there is an air lift to provide a sufficient cover of slurry for the air lift operation.

Figure 6:
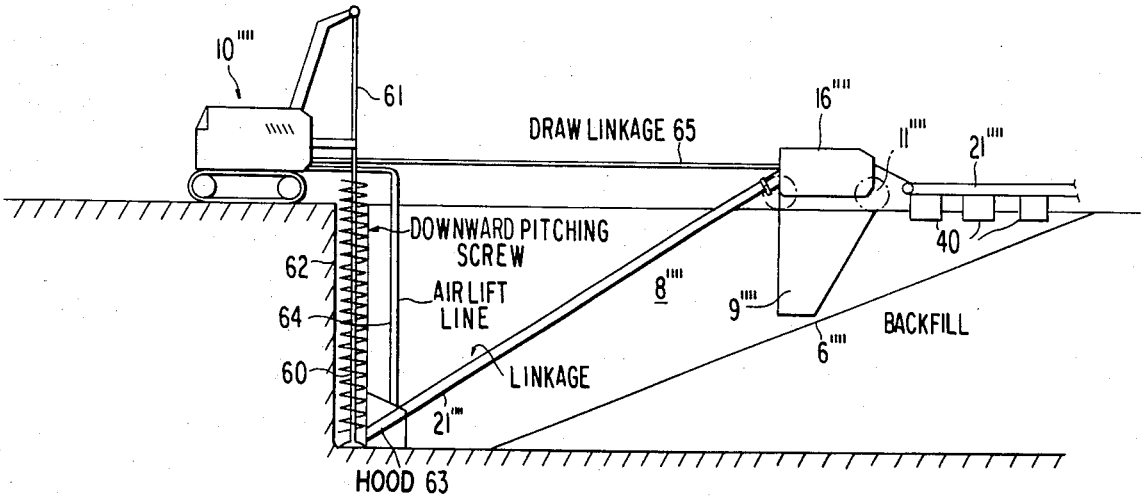
FIG. 6 is a diagrammatic elevational view of a further embodiment of a slurry trench apparatus incorporating the invention wherein a downward pitch screw and a submerged hood are used in conjunction with an air lift line are used for performing the excavation.

In FIG. 6, the power pack 10'''' is in advance of the excavation (and hence is not floated) and the excavating element is a screw 60 which has downward pitching flights and is supported and driven by a kelly bar 61. The downward pitching screw 60 cuts and scrapes material off the forward end 62 of the trench and advantageously conveys the material in a downward direction to a hood 63 which is supplied with air from air lift line 64, the excavated soil material, slurry and air being conveyed through a air lift line 21'''' to the backfill processing unti 16'''' which, in turn, delivers the process materials on conveyor 21'''' which is supported by floats 40'''' and the slurry 8'''' in the trench. Also, in this embodiment of the invention, the backfill processing unit 16'''' is drawn by a linkage 65 but it will be appreciated that a separate motive unit may be used for driving low pressure swamp tires 11''''.

Figure 7:
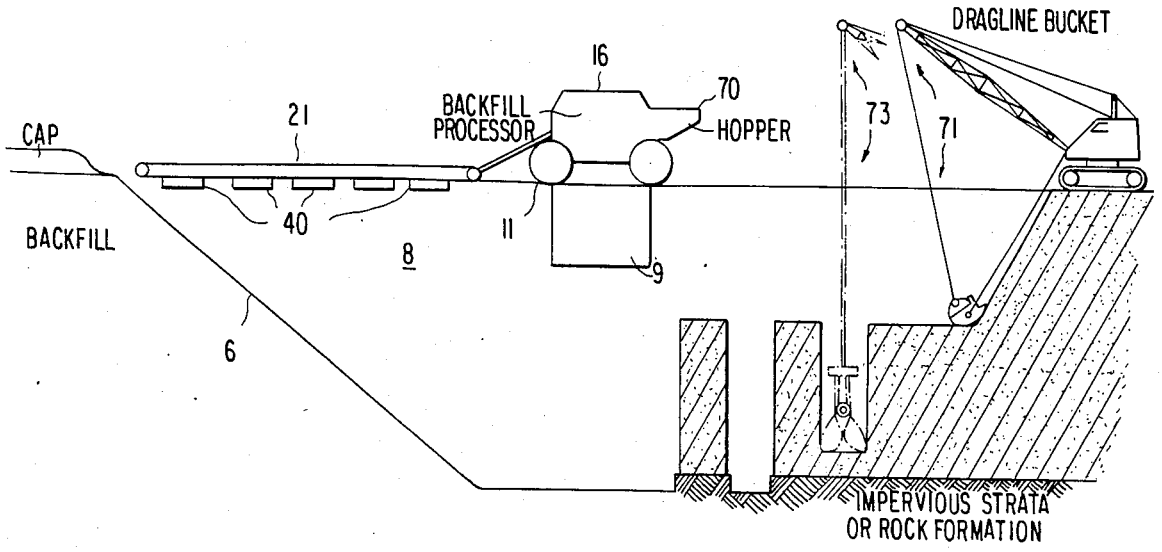
FIG. 7 is a diagrammatic elevational view of further embodiment of the invention wherein the slurry trenching excavation is performed by drag line buckets or clam shell buckets.

In FIG. 7, the invention is shown as incorporating a backfill processor having an extended hopper 70. A drag line bucket excavator 71 is positioned at the right end of the trench and material that it excavates is delivered to hopper 70 which is processed by the backfill processor 16 and delivered to conveyor 21 which is deposit it at the left end of the trench. Note in FIG. 7 the use of excess material that has been excavated to form a cap over the impervious wall. Instead of a drag line bucket, a clam shell excavator 73 may be used and operated in the same manner to deliver excavated material to the hopper 70. In this case, since the clam shell excavator and the drag line bucket (it will be appreciated that most bucket type excavators, including of course, backhoes, can be used in the same manner to practice the invention) may not have a proper mixture of excavated soil and bentonite if a soil-bentonite wall is to be formed, bentonite may be added to the backfill processor. Alternatively, if the wall forming material is to be a mixture of soil, cement and bentonite, then cement can be added in the backfill processor. At any rate, large portions of the apparatus are floated on the slurry in the trench, particularly those heavy and/or vibrating apparatus which need to be close to those portions of the trench walls which are basically supported solely by the slurry 8 in the trench. In cases such as where the drag line bucket excavator or clam shell excavator 73 can be located over the unexcavated portion along the line of the wall, then no floatation gear need be used. In this case the basic objective of the invention is satisfied if at least a part of the excavating apparatus and/or backfill processor are floating on the slurry in the trench.

Figure 8:
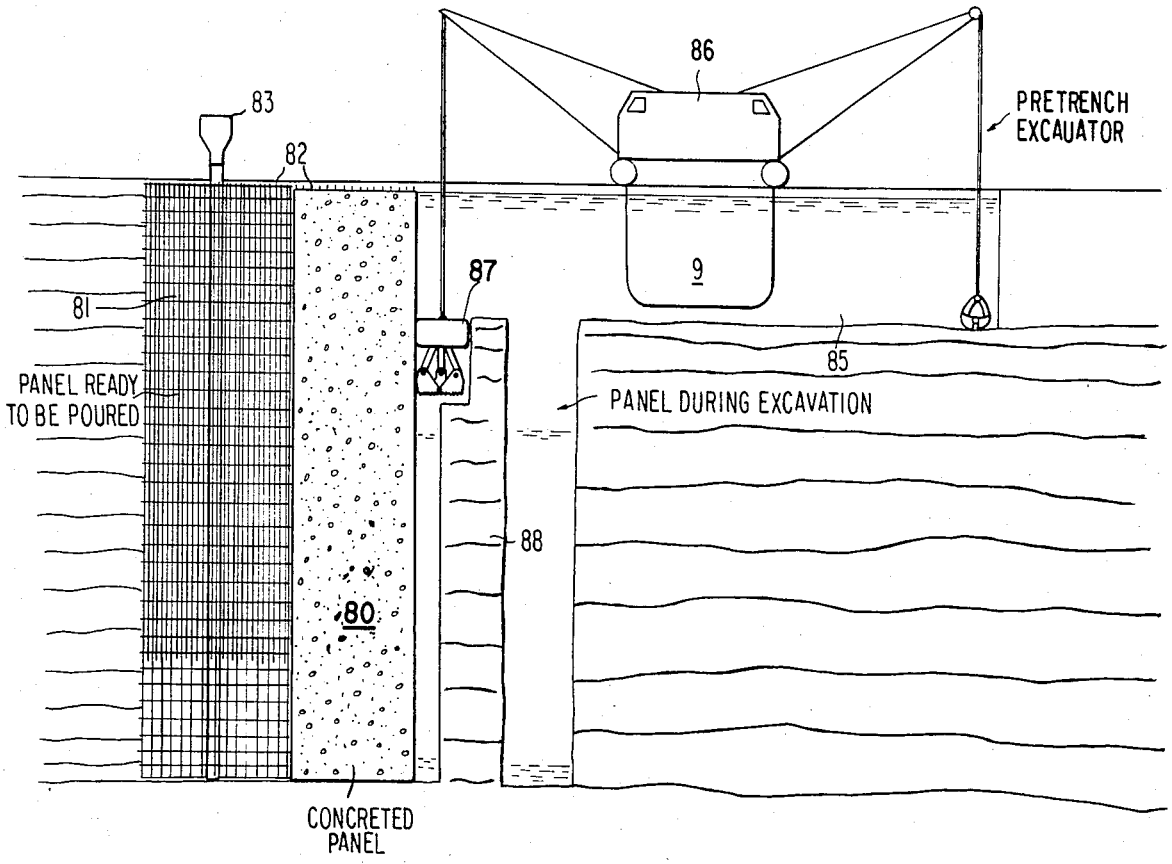
FIG. 8 is a diagrammatic elevational view of a further embodiment of a slurry trench apparatus and wall forming apparatus incorporating the invention wherein a reinforced concrete wall is being formed.

In FIG. 8, instead of using the excavated material to form the wall, it is disposed of in a conventional way but in this case, the wall forming material is concrete; as diagrammatically illustrated in FIG. 8, concrete panels 80 are alternately being formed and keyed to one another as well known in the art. As diagrammatically illustrated, a panel 81 is ready to be poured and includes a reinforcing cage 82 extending to the full length of the trench and a tremie pipe or tube 83 for receiving concrete is shown in position ready to receive concrete. In this case, a deeper than usual pretrench 85 is illustrated as being filled with slurry and supporting a crane 86 which operates a clam shell excavator 87. The excavator 87 is shown excavating adjacent a concreted panel 80 and is removing a portion of the column of soil 88 which remains. It will be appreciated that instead of excavating in columns of soil, the excavation made for each panel may be formed in layers or gradually down to the full depth of the trench. Instead of a clam shell excavator, various forms of chisels, chisel bits, rotary excavators endless, chain excavators and the like may be utilized with or without suction and/or circulation of the excavated material to remove the soil. Not shown are cleaners for cleaning the slurry so as to maintain its proper consistency during the operation, such cleaning equipment may be in like manner floated on the slurry during the excavating operation or may be a part of the crane unit 86 and its floatation gear 90.

With reference to FIG. 2 of the drawings herein, it will be noted that the equipment working space required along the line of the wall is very narrow and, with reference to the working platform only a minimum width need to be created to perform the work. The width of the working platform does not exceed the width of the proposed trench plus approximately 5 to 6 feet on each side thereof.

While I have shown and described a number of different embodiments of my invention, it will be appreciated that various other embodiments and adaptations of the invention will become obvious to those skilled in the art and it is intended that such obvious modifications and adpatations be encompassed within the spirit and scope of the claims appended hereto.

What is claimed is:

1. In a system for constructing a narrow underground wall, said system including a first apparatus for excavating from one end of a slurry filled trench and a second apparatus for filling the trench with a wall forming material, the improvement comprising floatation means and wherein at least a part of said first apparatus is floated at the surface of the slurry in said trench on said floatation means.

2. The system defined in claim 1 wherein said first apparatus includes ground engaging traction means straddling said trench and means for adjusting the buoyancy of said first apparatus to provide sufficient loading on said ground engaging traction means to permit same to move both said apparatus along the line of said trench on said floatation means without overloading the slurry supported trench walls.

3. The invention defined in claim 2 wherein said buoyancy adjustment means includes means for inserting and/or removing slurry from said floatation means immersed in the slurry in said trench.

4. In an apparatus for forming a narrow cutoff wall having means for excavating soil from one end of a long, slurry filled trench and backfilling the trench at the opposite end by depositing therein a mixture of the excavated soil and slurry from the trench, the improvement comprising ground engaging traction means straddling said trench, said ground engaging traction means including float means in said slurry for at least in part supporting said apparatus on said slurry in said trench and in part on said ground engaging traction means.

5. The apparatus defined in claim 4 including means for adjusting the buoyancy of said float means.

6. The apparatus defined in claim 4 including means for adjusting the loading on said ground engaging traction means by adjusting the buoyancy of said float means.

7. The invention defined in claim 4 wherein said float means includes a fin adapted to be immersed in said slurry for stabilizing said means for excavating.

8. The invention defined in claim 4 including a floating conveyor means for conveying the said mixture of excavated soil and slurry to a point for depositing in said trench.

9. In a slurry trench method of making a narrow cutoff wall wherein a trench is excavated in the presence of a liquid slurry and said cutoff wall is formed by a mixture of excavated soil and slurry, said mixture being prepared by mixing machinery which is located outside the trench, and backfilling the trench with the prepared mixture, the improvement comprising partially floating said mixing machinery on the slurry in the trench in advance of the backfill placed in the trench.

10. The invention defined in claim 9 including the step of adjusting the buoyancy of said floating mixing machinery.

11. A method of reducing the width of a working platform along the line of a slurry trench comprising floating at least a portion of the slurry trench machinery on the slurry in the trench and supporting the remainder on said working platform adjacent said slurry trench.

12. The method defined in claim 11 wherein the width of said working platform does not exceed the width of said slurry trench plus approximately five to six feet on each side thereof.

13. Slurry trench excavating apparatus having means for excavating soil from one end of a narrow slurry filled trench, the improvement comprising, float means, means at least in part supporting said slurry trench excavating apparatus on said float means, said float means being immersible in the slurry of said narrow slurry filled trench near the surface thereof to produce a buoyancy force on said slurry trench excavating apparatus and supporting the remaining portion on earth adjacent said trench.

14. The invention defined in claim 13 wherein said float means includes buoyancy adjustment means to adjust the buoyancy force of said float means on said slurry trench excavating apparatus.

* * * * *